US008120455B2

(12) United States Patent
Lai et al.

(10) Patent No.: US 8,120,455 B2
(45) Date of Patent: Feb. 21, 2012

(54) TRANSFORMER STRUCTURE

(75) Inventors: Yu-Chun Lai, Taoyuan Hsien (TW); Po-Yu Wei, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 98 days.

(21) Appl. No.: 12/624,930

(22) Filed: Nov. 24, 2009

(65) Prior Publication Data

US 2010/0207714 A1 Aug. 19, 2010

(30) Foreign Application Priority Data

Feb. 13, 2009 (TW) ..... 98104751 A

(51) Int. Cl.
*H01F 27/08* (2006.01)

(52) U.S. Cl. ..... 336/55

(58) Field of Classification Search ..... 336/55–62, 336/200, 232; 361/679.54
See application file for complete search history.

(56) References Cited

U.S. PATENT DOCUMENTS

| | | | | |
|---|---|---|---|---|
| 4,393,435 | A * | 7/1983 | Petrina | 361/674 |
| 6,492,890 | B1 * | 12/2002 | Woznlczka | 336/61 |
| 6,930,582 | B2 * | 8/2005 | Ball | 336/192 |
| 7,498,921 | B1 * | 3/2009 | Wang | 336/200 |
| 7,663,460 | B2 * | 2/2010 | Suzuki | 336/61 |
| 7,889,043 | B2 * | 2/2011 | Hsu et al. | 336/200 |
| 7,920,039 | B2 * | 4/2011 | Shabany et al. | 336/61 |
| 2004/0032312 | A1 * | 2/2004 | Yu et al. | 336/55 |

FOREIGN PATENT DOCUMENTS

CN 2162702 Y 4/1994

* cited by examiner

*Primary Examiner* — Tuyen Nguyen
(74) *Attorney, Agent, or Firm* — Kirton & McConkie; Evan R. Witt

(57) ABSTRACT

A transformer includes a case, a magnetic device and a thermally conductive layer. The case has a receptacle. The magnetic device is disposed within the receptacle, and includes a winding member and a magnetic core assembly. The thermally conductive layer is arranged between the magnetic device and the case for electrically isolating the magnetic device from the case. The heat generated by the magnetic device is transferred to the case through the thermally conductive layer and dissipated away to ambient air.

16 Claims, 5 Drawing Sheets

TRANSFORMER STRUCTURE

FIELD OF THE INVENTION

The present invention relates to a transformer, and more particularly to a transformer having enhanced heat-dissipating efficiency and reduced electromagnetic interference.

BACKGROUND OF THE INVENTION

A transformer has become an essential electronic component for voltage regulation into required voltages for various kinds of electric appliances. Referring to FIG. 1, a schematic exploded view of a conventional transformer is illustrated. The transformer 1 principally comprises a magnetic core assembly 11, a bobbin 12, a primary winding coil 13 and a secondary winding coil 14. The primary winding coil 13 and the secondary winding coil 14 are overlapped with each other and wounded around a winding section 121 of the bobbin 12. An insulating tape 15 is provided for isolation and insulation. The magnetic core assembly 11 includes a first magnetic part 111 and a second magnetic part 112. The middle portion 111*a* of the first magnetic part 111 and the middle portion 112*a* of the second magnetic part 112 are embedded into the channel 122 of the bobbin 12. The primary winding coil 13 and the secondary winding coil 14 interact with the magnetic core assembly 11 for voltage regulation.

Although the transformer 1 is effective for power conversion, there are still some drawbacks. For example, since the heat generated by the transformer 1 is dissipated away via a natural convection mechanism, the magnetic core assembly 11 and the winding section 121 of the bobbin 12 are exposed in order to increase the heat-dissipating efficiency. Under this circumstance, the transformer 1 readily generates electromagnetic interference (EMI), which adversely affects the neighboring circuits. Generally, additional high-level filters are used for suppressing EMI. The uses of the filters increase complexity of the circuitry layout and the fabricating cost.

In a case that the transformer 1 is used in a poorly ventilated environment, the heat generated by the transformer 1 is accumulated and the temperature of the transformer 1 is gradually increased because the heat is difficult to be transferred to the ambient air. The elevated temperature of the transformer 1 may result in damage of the transformer 1 and/or the electronic components neighboring the transformer 1. Under this circumstance, the performance and the use life of the transformer 1 and/or the whole electronic appliance will be deteriorated. Therefore, in designing a transformer, it is important to enhance the heat-dissipating efficiency of the transformer.

For increasing the heat-dissipating efficiency of the transformer 1, some measures are taken. For example, the material of the magnetic core assembly 11 is improved, the diameters and/or the coil turns of the primary winding coil 13 and the secondary winding coil 14 are modified, or the primary winding coil 13 and the secondary winding coil 14 are replaced by copper foils to increase the heat transfer area. Since the transformer structure is altered, a new mold of the transformer should be designed and made. The process of designing and making the new mold of the transformer increases extra cost.

Therefore, there is a need of providing a transformer having enhanced heat-dissipating efficiency and reduced electromagnetic interference so as to obviate the drawbacks encountered from the prior art.

SUMMARY OF THE INVENTION

It is an object of the present invention to provide a transformer having enhancing heat-dissipating efficiency, so that the possibility of casing heat accumulation is reduced and the use life of the transformer is extended.

Another object of the present invention provides a transformer with low electromagnetic interference.

In accordance with an aspect of the present invention, there is provided a transformer. The transformer includes a case, a magnetic device and a thermally conductive layer. The case has a receptacle. The magnetic device is disposed within the receptacle, and includes a winding member and a magnetic core assembly. The thermally conductive layer is arranged between the magnetic device and the case for electrically isolating the magnetic device from the case. The heat generated by the magnetic device is transferred to the case through the thermally conductive layer and dissipated away to ambient air.

In accordance with another aspect of the present invention, there is provided a transformer. The transformer includes a case, a magnetic device and a thermally conductive layer. The case has a receptacle. The magnetic device is disposed within the receptacle, and includes a primary winding assembly, a secondary winding assembly and a magnetic core assembly. The thermally conductive layer is arranged between the magnetic device and the case for electrically isolating the magnetic device from the case. The heat generated by the magnetic device is transferred to the case through the thermally conductive layer and dissipated away to ambient air.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
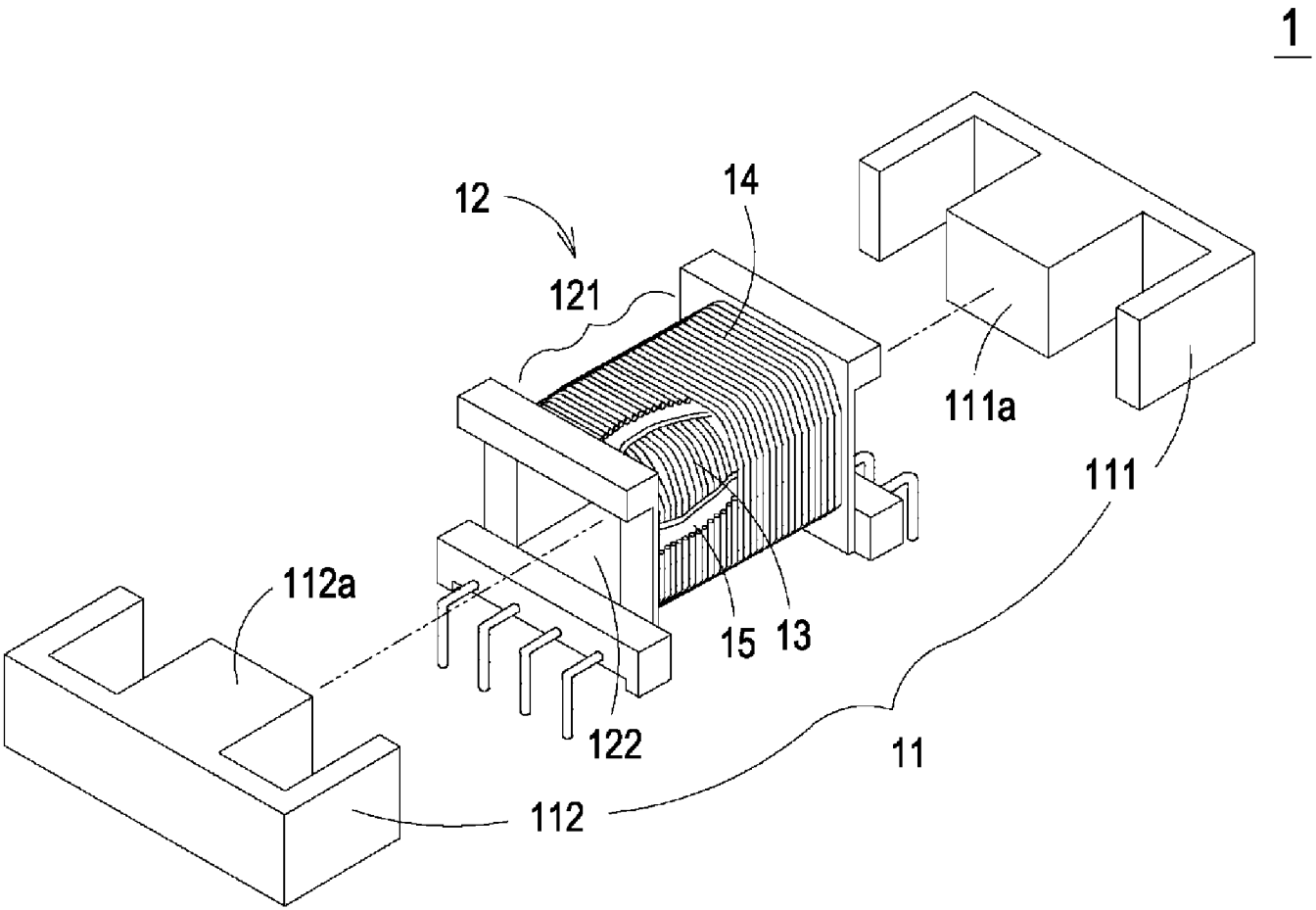
FIG. 1 PRIOR ART
FIG. 1 is a schematic exploded view of a conventional transformer.
Figure 2A:
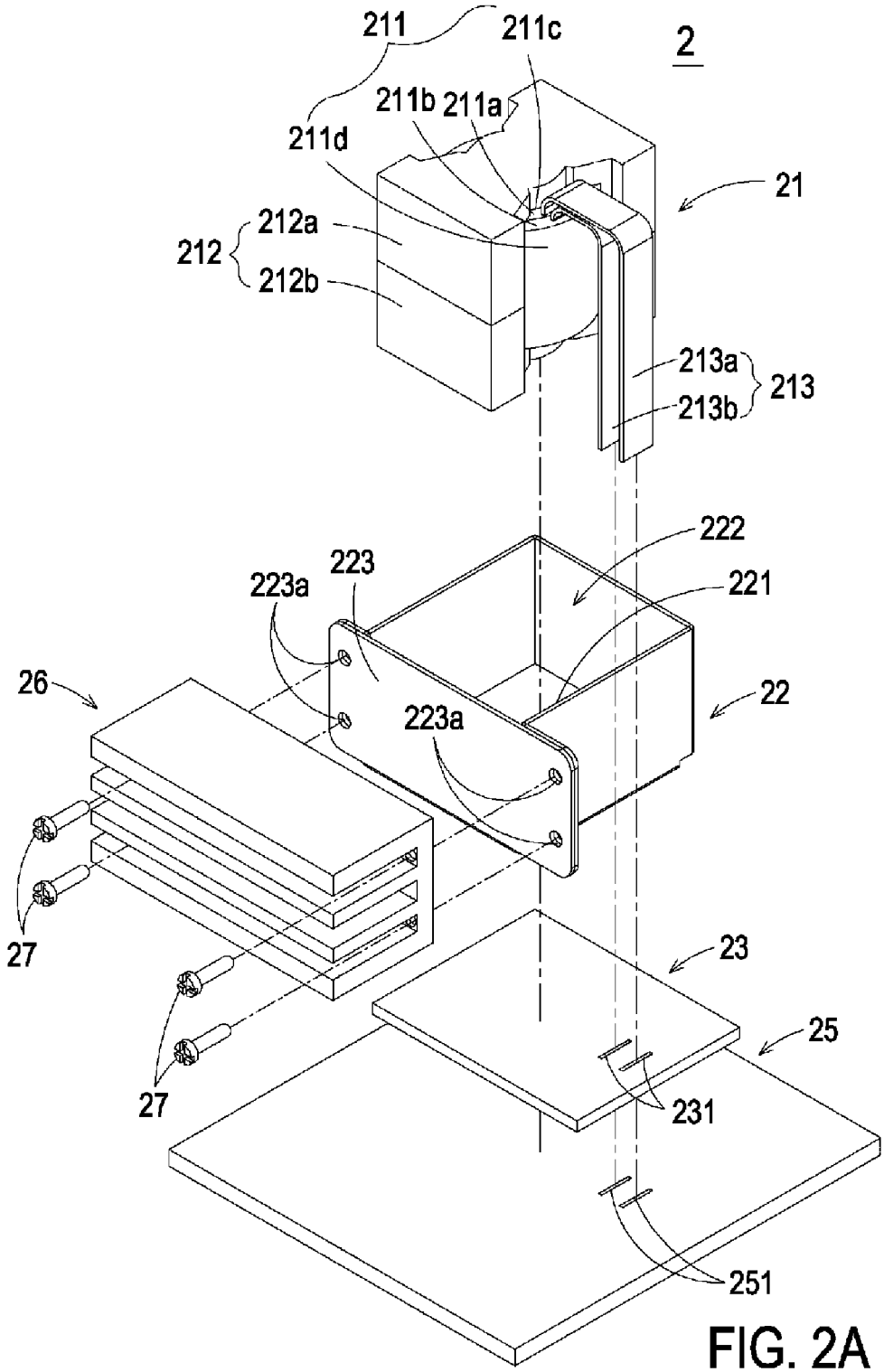
FIG. 2A is a schematic exploded view of a transformer according to an embodiment of the present invention.
Figure 2B:
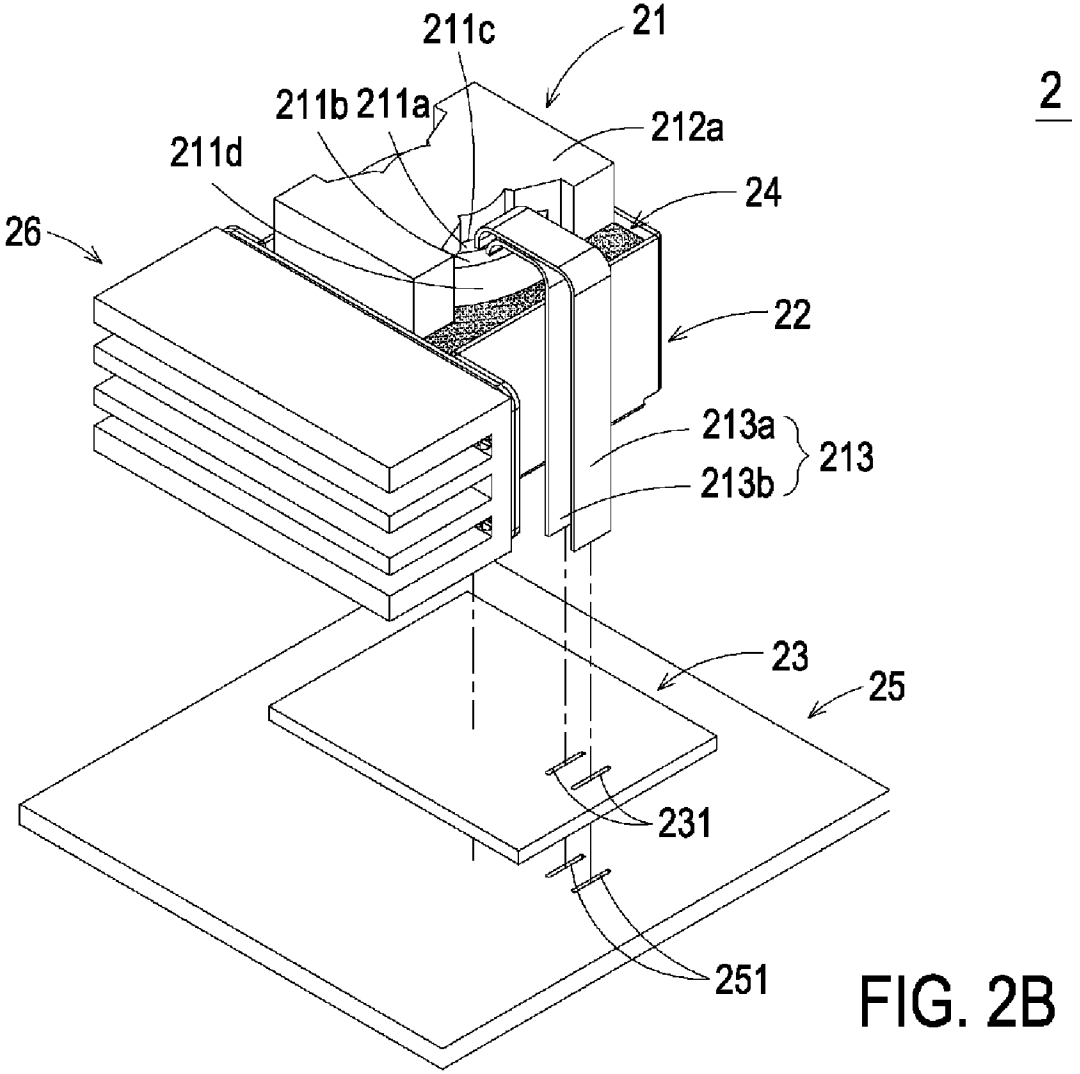
FIG. 2B is a schematic assembled view illustrating the combination of the magnetic device and the case of the transformer as shown in FIG. 2A.
Figure 2C:
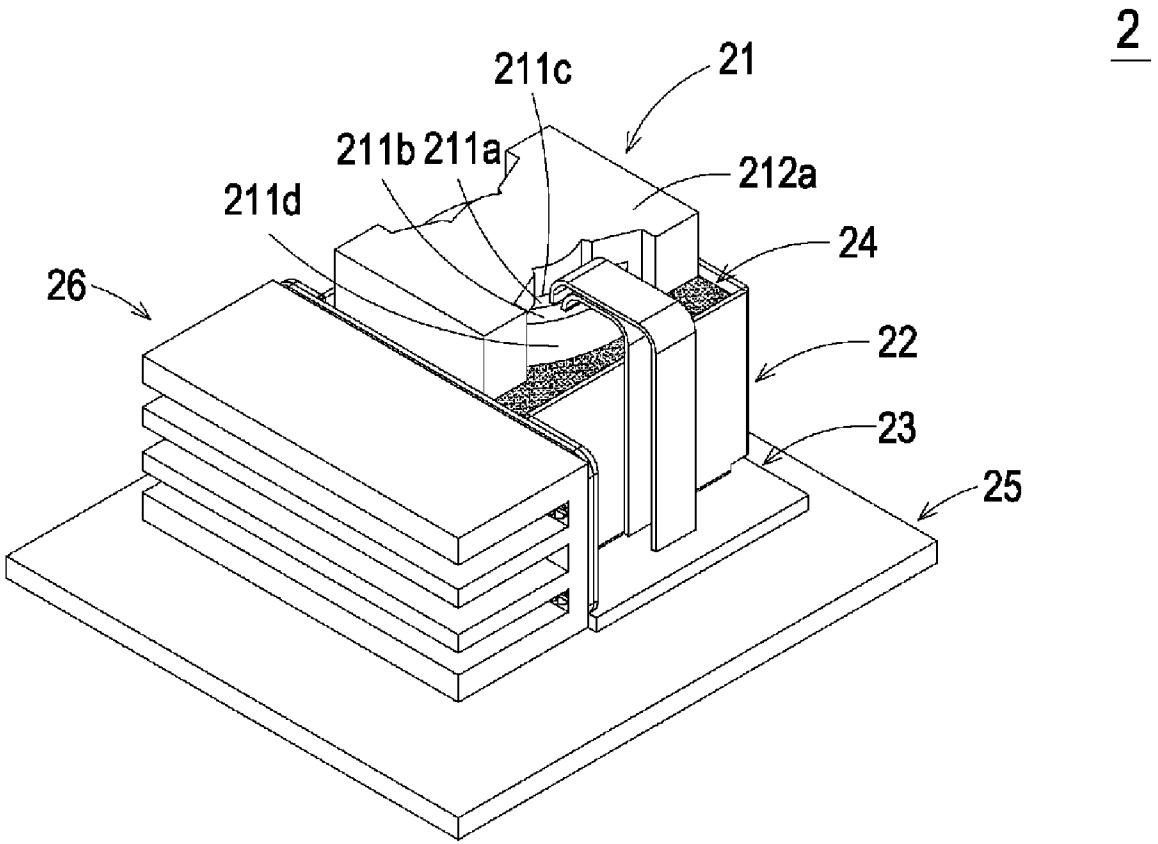
FIG. 2C is a schematic assembled view illustrating the transformer as shown in FIG. 2A.

FIG. 2A is a schematic exploded view of a transformer according to an embodiment of the present invention. FIG. 2B is a schematic assembled view illustrating the combination of the magnetic device and the case of the transformer as shown in FIG. 2A. FIG. 2C is a schematic assembled view illustrating the transformer as shown in FIG. 2A.

In FIG. 2A, the transformer 2 principally comprises a magnetic device 21 and a case 22. The magnetic device 21 includes a winding member 211 and a magnetic core assembly 212. The winding member 211 includes a primary winding assembly 211*a* and a secondary winding assembly 211*b*. In this embodiment, the primary winding assembly 211*a* and the secondary winding assembly 211*b* are formed of copper foils. For isolation and insulation, an insulating tape 211*d* is wound around the outer periphery of the transformer 2. The primary winding assembly 211*a* is produced by circularly winding a copper foil and thus a channel 211*c* is defined in the center of the primary winding assembly 211*a*. The secondary winding assembly 211*b* is wound around the primary winding assembly 211*a*. The magnetic core assembly 212 includes a first magnetic part 212*a* and a second magnetic part 212*b*. The upper portion and the lower portion of the winding member 211 are partially sheltered by the first magnetic part 212*a* and the second magnetic part 212*b*, respectively. In addition, the middle portions of the first magnetic part 212*a* and the second magnetic part 212*b* are partially embedded into the channel 211*c* of the winding member 211. It is noted that, however, those skilled in the art will readily observe that numerous modifications and alterations of the magnetic core assembly 212 may be made while retaining the teachings of the invention.

Please refer to FIG. 2A again. The magnetic device 21 includes at least one pin 213. An end of the pin 213 is connected to the winding member 211. The other end of the pin 213 is mounted on and electrically connected to a circuit board 25. For example, the primary winding assembly 211*a* and the secondary winding assembly 211*b* are electrically connected to the circuit board 25 through a first pin 213*a* and a second pin 213*b*, respectively. As such, the primary winding assembly 211*a* and the secondary winding assembly 211*b* interact with the magnetic core assembly 212 to achieve the purpose of voltage regulation.

In this embodiment, the winding member 211 includes the primary winding assembly 211*a* and the secondary winding assembly 211*b*. In some embodiments, the winding member 211 may include a single winding assembly, which is produced by circularly winding an enameled wire or a copper foil according to the practical requirements.

Please refer to FIGS. 2A and 2B again. The case 22 is made of a thermally conductive metallic material such as copper or aluminum. The case 22 of the transformer 2 is substantially a rectangular hollow box, and includes an entrance 221 and a receptacle 222. The entrance 221 is communicated with the receptacle 222. The magnetic device 21 is introduced into the receptacle 222 through the entrance 221 such that the magnetic device 21 is accommodated within the receptacle 222. After the magnetic device 21 is accommodated within the receptacle 222, a thermally conductive layer is interposed between the magnetic device 21 and the case 22. In some embodiments, the thermally conductive layer is a thermally conductive adhesive 24. The thermally conductive adhesive 24 is filled between the gap between the inner walls of the case 22 and the magnetic device 21 to encapsulate the magnetic device 21 within the receptacle 222. The use of the thermally conductive adhesive 24 can increase the heat transfer area of the magnetic device 21. As a consequence, the heat generated by the magnetic device 21 will be transferred to the case 22 through the thermally conductive adhesive 24. For increasing the heat-dissipating efficiency, the thermally conductive adhesive 24 is made of a material having a thermal conductivity. As such, the possibility of casing heat accumulation is largely reduced and thus the use life of the transformer is extended.

Please refer to FIG. 2B again. The pins 213*a* and 213*b* are bent by about 90 degrees and then extended in the downward direction. When the magnetic device 21 is disposed within the receptacle 222 of the case 22, the pins 213*a* and 213*b* are exposed outside the case 22. Since the pins 213*a* and 213*b* are flexible metallic sheets, the bending degrees of the pins 213*a* and 213*b* are readily shifted if the pins 213*a* and 213*b* are subject to an impact. Under this circumstance, the pins 213*a* and 213*b* are no longer aligned with corresponding insertion holes 251 of the circuit board 25 and thus fail to be successfully mounted on the circuit board 25. For facilitating positioning the pins 213*a* and 213*b*, the transformer 2 further includes a positioning plate 23. The area of the positioning plate 23 is greater than the bottom area of the case 22. Corresponding to the pins 213, perforations 231 that have the same number as the pins 213 are formed in the positioning plate 23. After the magnetic device 21 is disposed within the receptacle 222 of the case 22, the pins 213*a* and 213*b* are penetrated through corresponding perforations 231 of the positioning plate 23, so that the pins 213*a* and 213*b* are initially positioned by the positioning plate 23. The resulting structure is shown in FIG. 2C. The use the positioning plate 23 can facilitate positioning the pins 213*a* and 213*b*. In addition, the positioning plate 23 can be used to support the case 22.

Please refer to FIGS. 2A, 2B and 2C again. The case 22 has a first side plate 223. Several bolt holes 223*a* are formed in the first side plate 223 of the case 22. By penetrating fastening elements 27 (e.g. screws) through corresponding bolt holes 223*a*, another heat-dissipating device 26 (e.g. a water cooling device or a heat sink) may be attached onto the first side plate 223 of the case 22. The heat generated by the magnetic device 21 is transferred to the case 22 through the thermally conductive adhesive 24 and then quickly dissipated away by the heat-dissipating device 26, so that the heat-dissipating efficiency is enhanced. Moreover, since the case 22 is made of a metallic material and the magnetic device 21 is shielded by the case 22, the electromagnetic interference generated by the transformer 2 is effectively suppressed. Under this circumstance, less number of filters (not shown) needs to be mounted on the circuit board 25 and thus the circuitry layout of the circuit board 25 is simplified.

Figure 3:
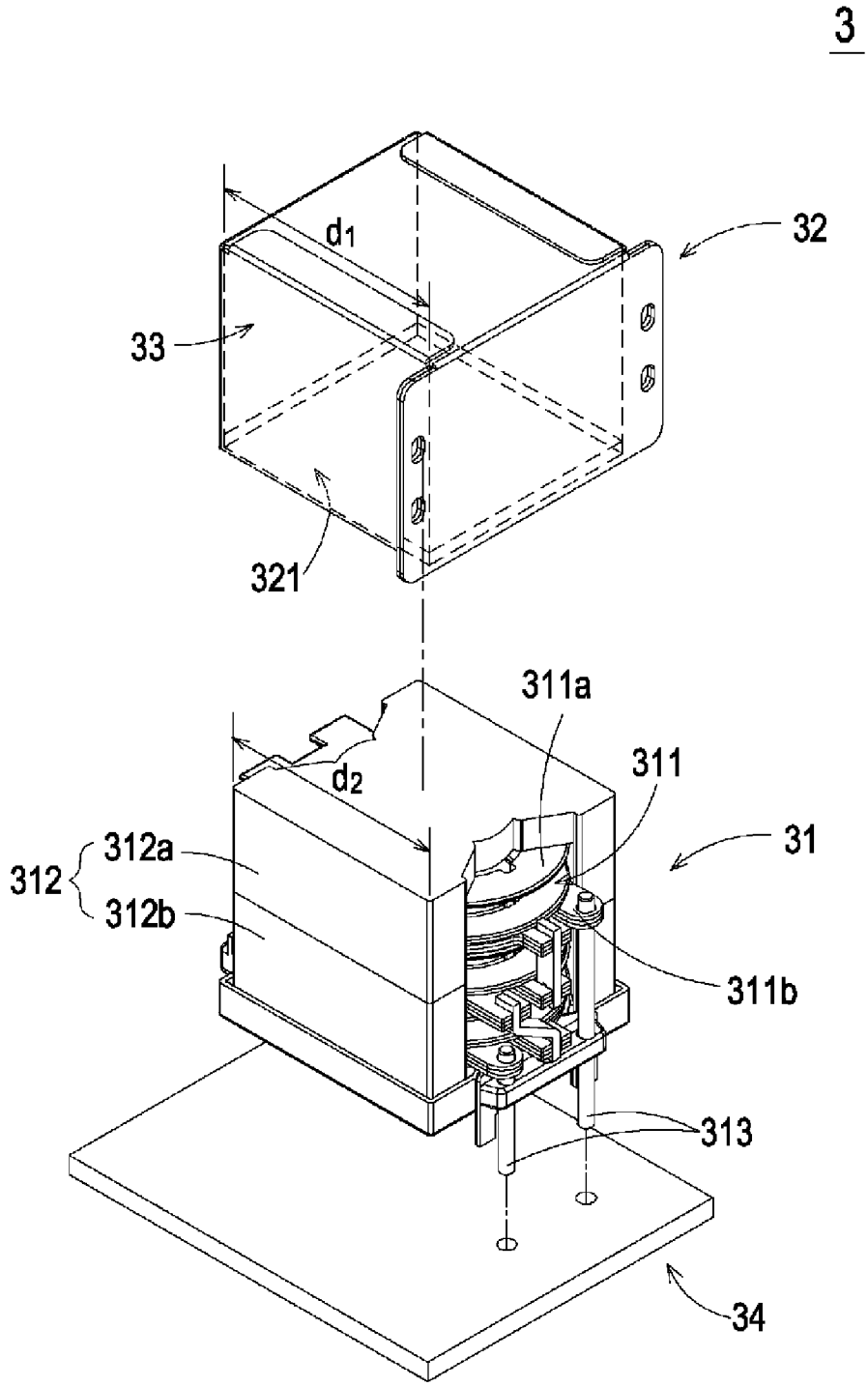
FIG. 3 is a schematic exploded view of a transformer according to another embodiment of the present invention.

FIG. 3 is a schematic exploded view illustrating a transformer according to anther embodiment of the present invention. As shown in FIG. 3, the transformer 3 principally comprises a magnetic device 31, a case 32 and a thermally conductive layer 33. The magnetic device 31 includes a winding member 311 and a magnetic core assembly 312. The winding member 311 is electrically connected to a circuit board 34 through at least two pins 313. The magnetic core assembly 312 includes a first magnetic part 312*a* and a second magnetic part 312*b*. The upper portion and the lower portion of the winding member 311 are partially sheltered by the first magnetic part 312*a* and the second magnetic part 312*b*, respectively. In addition, the middle portions of the first magnetic part 312*a* and the second magnetic part 312*b* are partially embedded into a channel (not shown) of the winding member 311. As such, the primary winding assembly 311*a* and the secondary winding assembly 311*b* interact with the magnetic core assembly 312 to achieve the purpose of voltage regulation. In this embodiment, the winding member 311 includes a winding frame 311*a*. A winding assembly 311*b* is wound around the winding frame 311*a*. According to the practical requirements, the winding assembly 311*b* is produced by circularly winding an enameled wire or a copper foil.

The case 32 is made of a thermally conductive metallic material such as copper or aluminum. Similarly, the case 32 of the transformer 3 is substantially a rectangular hollow box. In some embodiments, the thermally conductive layer is a thermal pad 33. The thermal pad 33 is attached on an inner wall 321 of the case 32. The length d1 of the thermal pad 33 is substantially equal to the length d2 of the magnetic device 31. Consequently, after the magnetic device 31 is accommodated within the receptacle of the case 32, the thermal pad 33 is also in direct contact with the magnetic device 31. The use of the thermal pad 33 can increase the heat transfer area of the magnetic device 31. As a consequence, the heat generated by the magnetic device 31 will be transferred to the case 32 through the thermal pad 33. For increasing the heat-dissipating efficiency, the thermal pad 33 is made of a material having a thermal conductivity. As such, the possibility of casing heat accumulation is largely reduced and thus the use life of the transformer is extended.

Moreover, the thermal pad 33 can also provide an insulating efficacy in order to avoid short circuit between the magnetic device and the case and meet the safety demand.

The concepts of the present invention can be expanded to many applications. For example, if the temperature of a magnetic device mounted on a circuit board is very high, the user may enclose a case around the magnetic device and interpose a thermal pad between the magnetic device and the case. Under this circumstance, the purpose of increasing the heat-dissipating efficiency of the magnetic device is achievable and thus the temperature of a magnetic device is decreased. In other words, the magnetic device can continuously work without the need of designing a new magnetic device or replacing the original magnetic device with a new one. As a consequence, the use of the transformer of the present invention is very cost-effective. On the other hands, if the transformer is used in different environments, the user only needs to select a proper case complying with the environment. That is, the cost and the time of reproducing different transformers are saved.

In the above embodiments, the magnetic device of the transformer includes a primary winding assembly and a secondary winding assembly, or includes a single winding assembly. It is noted that, however, those skilled in the art will readily observe that numerous modifications and alterations of the winding member and the magnetic core assembly may be made while retaining the teachings of the invention. In other words, the structure of the transformer of the present invention is not restricted as long as a magnetic device is sheltered by a case and a thermally conductive layer is interposed between the magnetic device and the case. Since the heat-dissipating efficiency of the magnetic device is enhanced and the thermally conductive layer offers an insulating efficacy, the transformer of present invention can be used in a stringent or poorly ventilated environment (e.g. a motor room, an automobile and the like) for an extended period.

From the above description, the transformer of the present invention includes a case, a magnetic device and a thermally conductive layer. The use of the thermally conductive layer can increase the heat transfer area of the magnetic device. As a consequence, the heat generated by the magnetic device will be transferred to the case through the thermally conductive layer. Since the possibility of casing heat accumulation is largely reduced, thus the use life of the transformer is extended. Moreover, since the case is made of a metallic material and the magnetic device is shielded by the case, the electromagnetic interference generated by the transformer is effectively suppressed. Under this circumstance, less number of filters needs to be mounted on the circuit board and thus the circuitry layout of the circuit board is simplified.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer comprising:

a case having a receptacle;

a magnetic device disposed within said receptacle, and including a winding member and a magnetic core assembly; and a thermally conductive layer arranged between said magnetic device and said case for electrically isolating said magnetic device from said case, wherein multiple bolt holes are formed in a first side plate of said case, multiple fastening elements are penetrated through corresponding bolt holes for attaching a heat-dissipating device onto said first side plate of said case, and the heat generated by said magnetic device is transferred to said case through said thermally conductive layer and dissipated away to ambient air.

2. The transformer according to claim 1 wherein said winding member is formed of a copper foil.

3. The transformer according to claim 1 wherein said winding member further comprises at least a pin, which is connected to a circuit board.

4. The transformer according to claim 3 wherein said transformer further includes a positioning plate having at least a perforation corresponding to said pin, wherein said pin is penetrated through said perforation so as to be positioned by said positioning plate.

5. The transformer according to claim 1 wherein said case is made of a thermally conductive metallic material.

6. The transformer according to claim 1 wherein said heat-dissipating device includes a water cooling device or a heat sink.

7. The transformer according to claim 1 wherein said thermally conductive layer is a thermally conductive adhesive, which is filled between a gap between a inner wall of said case and said magnetic device to encapsulate said magnetic device within said receptacle and increase a heat transfer area of said magnetic device.

8. The transformer according to claim 1 wherein said thermally conductive layer is a thermal pad, which is attached between said magnetic device and said case for increasing a heat transfer area of said magnetic device.

9. A transformer comprising:

a case having a receptacle;

a magnetic device disposed within said receptacle, and including a primary winding assembly, a secondary winding assembly and a magnetic core assembly; and a thermally conductive layer arranged between said magnetic device and said case for electrically isolating said magnetic device from said case, wherein multiple bolt holes are formed in a first side plate of said case, multiple fastening elements are penetrated through corresponding bolt holes for attaching a heat-dissipating device onto said first side plate of said case, and the heat generated by said magnetic device is transferred to said case through said thermally conductive layer and dissipated away to ambient air.

10. The transformer according to claim 9 wherein at least one of said primary winding assembly and secondary winding assembly is formed of a copper foil.

11. The transformer according to claim 9 wherein said primary winding assembly and secondary winding assembly further comprises a first pin and a second pin, respectively, and said first pin and said second pin are connected to a circuit board.

12. The transformer according to claim 11 wherein said transformer further includes a positioning plate having at least a first perforation and a second perforation corresponding to said first pin and said second pin, respectively, wherein said first pin and said second pin are respectively penetrated through said first perforation and said second perforation so as to be positioned by said positioning plate.

13. The transformer according to claim 9 wherein said case is made of a thermally conductive metallic material.

14. The transformer according to claim 9 wherein said heat-dissipating device includes a water cooling device or a heat sink.

15. The transformer according to claim 9 wherein said thermally conductive layer is a thermally conductive adhesive, which is filled between a gap between an inner wall of said case and said magnetic device to encapsulate said magnetic device within said receptacle and increase a heat transfer area of said magnetic device.

16. The transformer according to claim 9 wherein said thermally conductive layer is a thermal pad, which is attached between said magnetic device and said case for increasing a heat transfer area of said magnetic device.

* * * * *